US005212930A

United States Patent [19]

Raudat

[11] Patent Number: 5,212,930

[45] Date of Patent: May 25, 1993

[54] CONTINUOUS MOTION PACKER FOR LOADING PARALLEL COLUMNS OF UPRIGHT CONTAINERS INTO PARTITIONED PACKING CASES

[75] Inventor: John L. Raudat, North Madison, Conn.

[73] Assignee: Standard-Knapp, Inc., Portland, Conn.

[21] Appl. No.: 798,220

[22] Filed: Nov. 26, 1991

[51] Int. Cl.[5] ..... B65B 5/08

[52] U.S. Cl. ..... 53/263; 53/246; 53/247; 53/534; 53/539

[58] Field of Search ..... 53/246, 247, 251, 255, 53/263, 448, 475, 534, 539

[56] References Cited

U.S. PATENT DOCUMENTS

| | | | |
|---|---|---|---|
| 3,805,476 | 4/1974 | Kawamura et al. | 53/448 |
| 4,064,987 | 12/1977 | Rowan | 53/246 X |
| 4,151,788 | 5/1979 | Wiseman | 53/263 X |
| 4,389,832 | 6/1983 | Calvert | 53/539 X |
| 4,531,345 | 7/1985 | Nigrelli et al. | 53/534 |
| 4,704,841 | 11/1987 | Langenbeck | 53/475 X |
| 4,793,117 | 12/1988 | Raudat et al. | 53/534 X |
| 4,901,501 | 2/1990 | Raudat et al. | 53/539 X |
| 4,998,399 | 3/1991 | Lutzke et al. | 53/534 X |
| 5,020,306 | 6/1991 | Raudat | 53/251 X |

*Primary Examiner*—Lowell A. Larson
*Assistant Examiner*—Daniel Moon
*Attorney, Agent, or Firm*—McCormick, Paulding & Huber

[57] ABSTRACT

Upright containers of non-rectangular shape move downstream in a plurality of parallel columns and in laterally aligned rows toward a load station where the containers are deposited row-on-row into partitioned packing cases. The cases move continuously through the load station end-to-end and are indexed to the rows of containers by depending pegs that move in between the containers from above. The pegs are provided in flights of an overhead flight bar conveyor and camming means keeps these pegs oriented perpendicular to the upright containers as the legs move in between the containers to control the containers dropped at the load station.

8 Claims, 5 Drawing Sheets

CONTINUOUS MOTION PACKER FOR LOADING PARALLEL COLUMNS OF UPRIGHT CONTAINERS INTO PARTITIONED PACKING CASES

BACKGROUND OF THE INVENTION

This invention relates generally to apparatus for loading upright containers arranged in parallel columns into upwardly open packing cases as the cases move in end-to-end relationship through a load station. The packing cases may be of the partitioned type and the present invention provides a method and apparatus for loading such article columns as both the articles and the cases move continuously in a downstream direction.

DESCRIPTION OF THE PRIOR ART

In continuous motion packers of the type adapted to load containers moving continuously into packing cases that also move continuously it has generally been the case that the packing cases are themselves separated from one another and the containers grouped for loading into the separated cases as taught for example in prior art U.S. Pat. No. 2,978,854 issued to Fairest, U.S. Pat. No. 3,805,476 issued to Kawamura et al, and U.S. Pat. No. 3,553,927 issued to Anglade. In these prior art patents the cases are not fed end-to-end one behind the other, but each case must be carefully controlled as it progresses through the load station.

Another approach to packaging continuously moving upright containers is possible if only two columns of containers are to be loaded. The cases move in end-to-end relationship and the containers are controlled by means of side belts or equivalent structure to index the containers so that they are deposited within cases moving below them into the load station. See for example U.S. Pat. No. 4,389,832 to Calvert, U.S. Pat. No. 4,901,501 to Raudat et al, and a more recent U.S. Pat. No. 5,020,306 issued to Raudat. The machine disclosed in the above mentioned patent suffers from the disadvantage that only two columns of cylindrical containers can be so loaded.

SUMMARY OF THE INVENTION

In accordance with the present invention an apparatus or method is disclosed for loading upright containers into packing cases that may include partitions for receiving the individual containers. The cases are moved continuously in end-to-end relationship such that the rear panel of each case abuts the front panel of the next case at least along a path traversing the load station. The upright containers move in a plurality of parallel columns and in laterally aligned rows along a path above that of the cases, but in the same general downstream direction the upright containers in each column abut one another as they approach the load station.

An overhead flight bar conveyor system has a plurality of spaced flights provided at a pitch distance (P) slightly greater than the girth dimension of the containers to be loaded, and each flight carries a plurality of depending pegs arranged in a grid like pattern of parallel lateral and longitudinal lines of pegs. The flight bar conveyor defines an angled or inclined path for the flights so that the pegs are adapted to merge with the containers as the containers approach the load station. The depending pegs must move into spaces between the adjacent containers and the containers need only be non-rectangular. Camming means is provided in the flight bar conveyor means to assure that the pegs remain perpendicular to the upright containers approaching the load station. Projecting container support fingers are provided at the downstream end of the infeed conveyor to support the columns of containers in cooperation with the depending pegs of the overhead flight bar conveyor until the containers arrive at a downstream end of these fingers where each row of bottles drop by gravity into the pockets defined by the partitions of the packing case.

The principal object of the present invention is to provide a continuous motion packer for handling a plurality of columns of upright containers where the containers move in line and where the packing cases into which the containers are to be loaded also move in line to and through a load station. At the load station each row of containers is dropped a distance not significantly greater than the height of the container itself, and generally this height corresponds to the height of the packing case into which the containers are to be loaded.

Certain of the pegs comprise container pegs configured to enter the space between adjacent containers, and other of these pegs are configured to not only enter the space between the adjacent containers, but also to hold back the container rows upstream thereof in order to provide a gap in the direction of container movement, which gap corresponds in dimension to the combined thickness of the abutting front and rear portions of the end-to-end cases being loaded. These latter pegs are referred to as case pegs.

DETAILED DESCRIPTION

Figure 1:
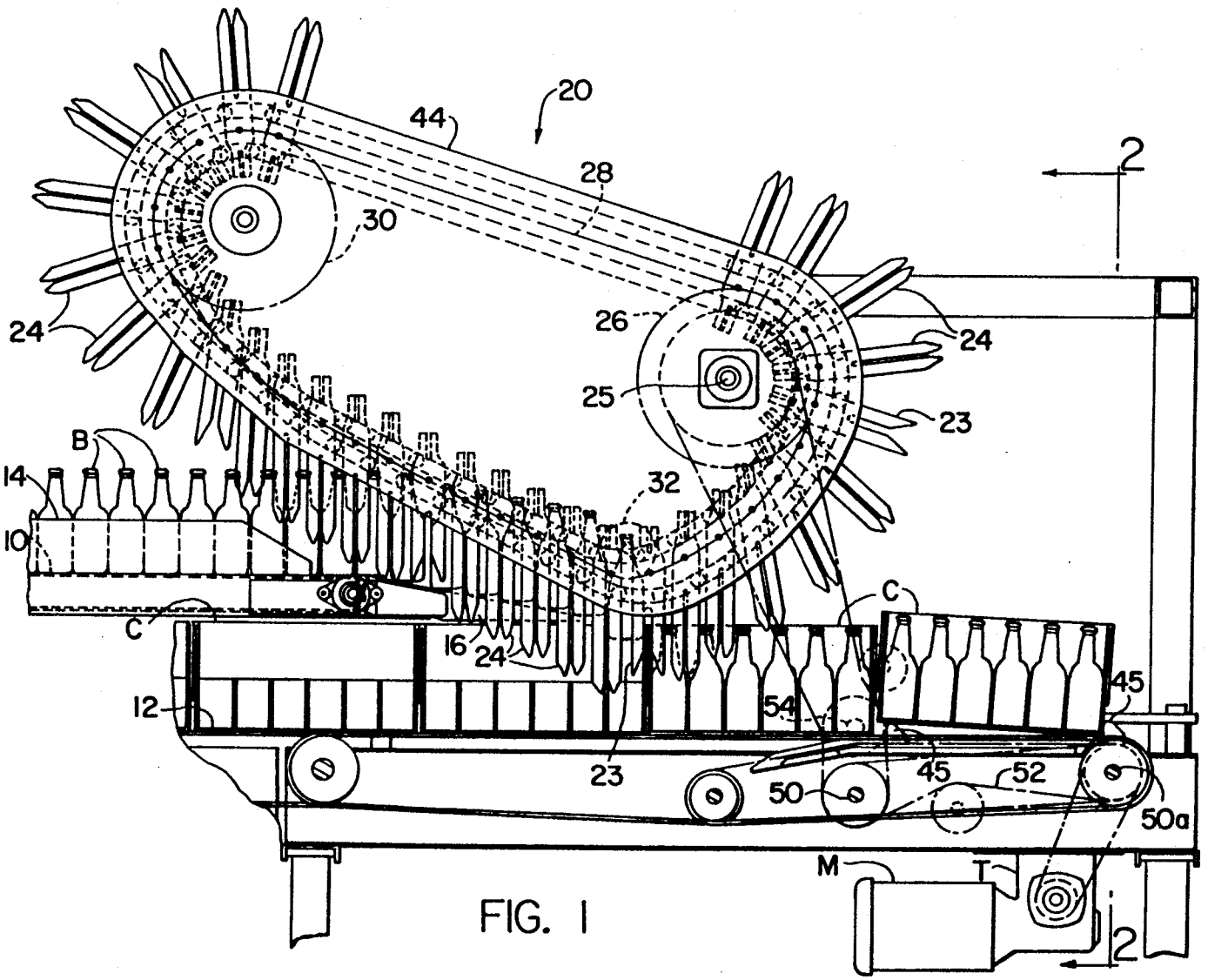
FIG. 1 is a side elevation view illustrating in schematic fashion an apparatus incorporating the present invention.

Upright containers such as glass or plastic bottles B, B are conventionally fed from left to right in FIG. 1 by an underlying conveyor 10. The conveyor 10 is continuously driven at a speed such that the containers move in upright condition between a plurality of parallel lane guides 14, 14 which align the bottles in a plurality of parallel columns (only one of which is shown in FIG. 1). These containers B, B are also aligned laterally in rows so that the parallel columns of containers not only abut one another in the longitudinal direction, but are closely spaced with respect to one another in a lateral direction.

Figure 3:
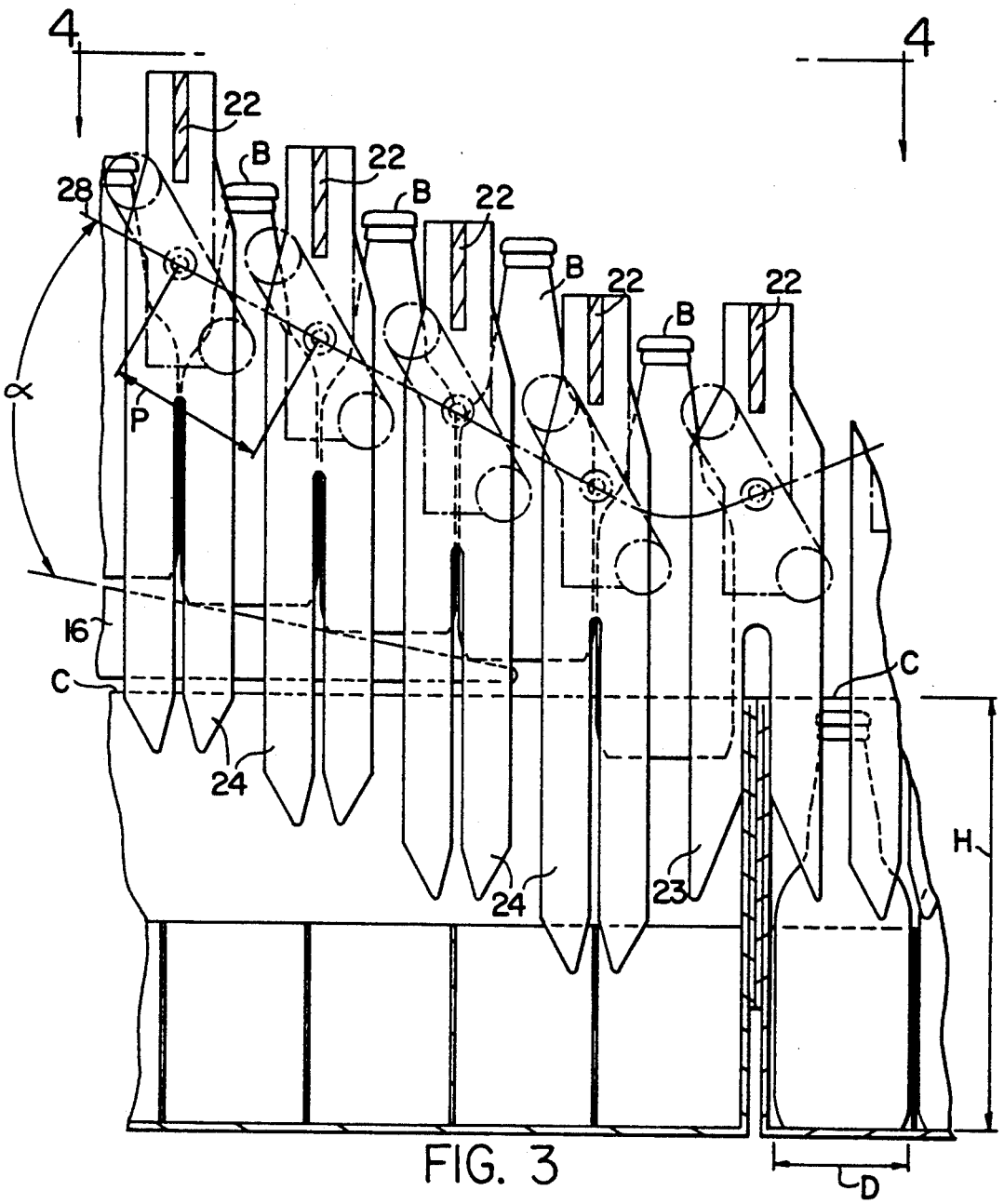
FIG. 3 is an enlarged side elevational view of the containers and cases approaching the load station and shows the container row being dropped at the load station as well as the departure of the cases and containers from the load station.

The packing cases C, C are also fed in the downstream direction by a continuously operating case conveyor 12, and it is a feature of the present invention that both the cases C, C and the containers B, B are moved by the line pressure afforded as a result of the underlying conveyors 12 and 10 respectively in a downstream direction toward the load station shown in FIG. 3. It is an important feature of the present invention that both the cases and the containers continue to move in abutting relationship to one another in the downstream direction through the load station where the containers are dropped row by row into an awaiting case as both the cases and the containers move in synchronized relationship to one another through the load station.

Figure 4:
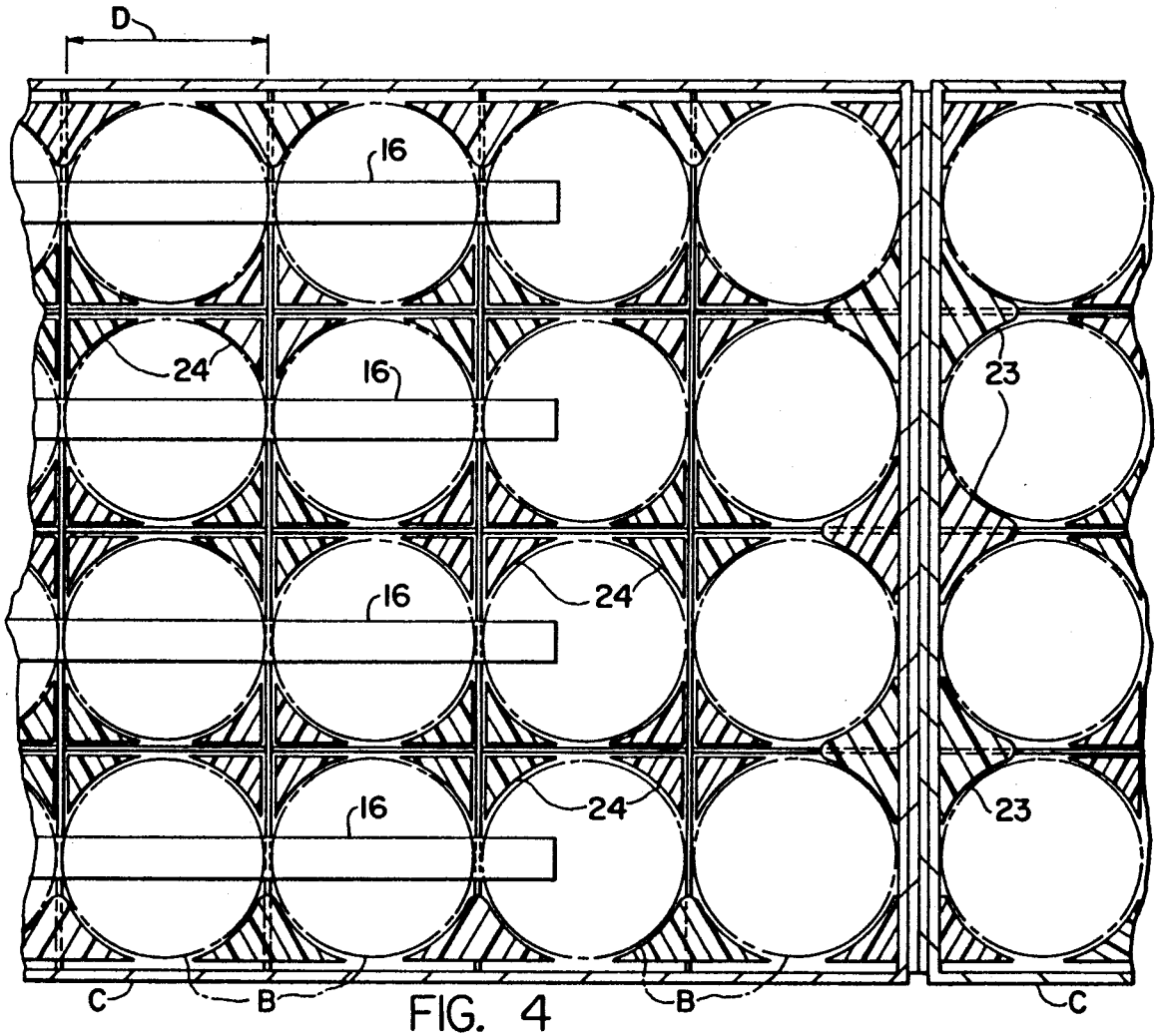
FIG. 4 is a horizontal section taken generally on the line 4—4 of FIG. 3.

The lane guides 14, 14 terminate short of the load station as shown in FIG. 1, and short of the downstream end of the conveyor 10 which provides downstream movement of the containers toward the load station as described. At the downstream end of the container conveyor 10 a plurality of fingers 16, 16 are mounted cantilever fashion to the frame of the machine and these fingers have free end portions that project in the downstream direction to define at their downstream ends the load station where each row of containers is successively dropped into an awaiting packing case. These fingers 16, 16 have upper edges that define a downwardly inclined ramp for the containers. These upper edges of the fingers are oriented at an angle with respect to the horizontal path of movement of the containers on the conveyor 10. These fingers 16, 16 are shown in top plan view in FIG. 4, and as illustrated in FIG. 4 these fingers are aligned with the center line of each column of containers supported thereon, with spaces or gaps provided between the fingers for a purpose to be described.

As the containers move off the downstream end of the container conveyor 10 and beyond the lane guides 14,14 they are guided by depending pegs 24, 24 that move downwardly into the spaces between the containers. As shown in FIG. 4 these pegs 24, 24 have a shape such that they fill these spaces between the containers.

The pegs are provided on laterally extending flight bars 22, 22 and the flight bars are spaced from one another in an overhead flight bar conveyor system 20 such that the pegs are arranged in a grid-like pattern of lateral and longitudinal extending lines. As so configured the pegs move downwardly between the containers as illustrated in FIGS. 3 and 4.

The overhead flight bar conveyor system 20 has laterally spaced conveyor chains 28, 28 supporting the flights 22, 22. These flights are provided at a pitch distance (P) slightly greater than the girth dimension or diameter D of the containers to be loaded, and each such flight carries a plurality of depending pegs 24, 24. The pegs are arranged in laterally spaced relationship on the flights and the flights are spaced from one another longitudinally so as to provide a grid-like pattern of parallel lateral and longitudinal lines of pegs as shown to best advantage in FIG. 4.

The flight bar conveyor system 20 defines an angled or inclined path for the flights defining an angle with the inclined path of the fingers so that the pegs are adapted to merge with the containers as the containers approach the load station. The depending pegs move downwardly into the spaces between the adjacent containers, and in fact continue to move downwardly so as to move into the gaps between the fingers and into the packing cases so that the containers can be guided as they drop off the ends of the fingers at the load station.

The flight bar conveyor system 20 also includes camming means to assure that the pegs remain vertical to assure the containers moving down the ramp defined by the upper edges of the fingers and also remain so oriented. Actually, the camming means serve to orient the pegs continuously during their travel in the closed loop defined by the flight bar conveyor system of FIG. 1. However, it is during the downwardly inclined path of travel for the flights 22, 22 and their associated pegs 24, 24 that the camming means serves the important function of maintaining these pegs in a substantially vertical orientation and that the containers are upright not only as the containers move along the downstream end portion of the container conveyor 10, but also as the containers move further downstream along the inclined ramp surface defined by the cantilevered fingers 16, 16.

As the containers reach the downstream ends of these fingers they are dropped row on row into the awaiting packing case and the containers are held in an upright orientation by the container pegs 24, 24 at the load station itself. The pegs continue to move downwardly inside the case C and also serve to index the case to the containers as a result of having slotted lower end portions which are adapted to receive the partitions provided within the case.

In order to index the cases with respect to the containers being loaded at the load station certain pegs called case pegs 23, 23 are provided of slightly different geometry so that bifurcated lower end portions are adapted to engage the abutting front and rear panels of the adjacent case at the load station as best shown in FIGS. 3 and 4. These case pegs 23, 23 can be seen to be of somewhat larger cross sectional configuration and to have a somewhat shorter overall vertical length than the container pegs 24, 24 so as to facilitate capturing the front and rear panels of the adjacent cases at the load station. These case pegs 23, 23 also act on the containers to separate the first and last rows of containers being deposited into the adjacent cases. As shown in FIGS. 3 and 4 these oversized pegs 23, 23 have a cross sectional configuration such that the upstream container row is held back relative to the downstream container row to achieve the required spacing between adjacent rows to accommodate the thickness of the abutting end panels and end flaps of the adjacent cases.

Figure 2:
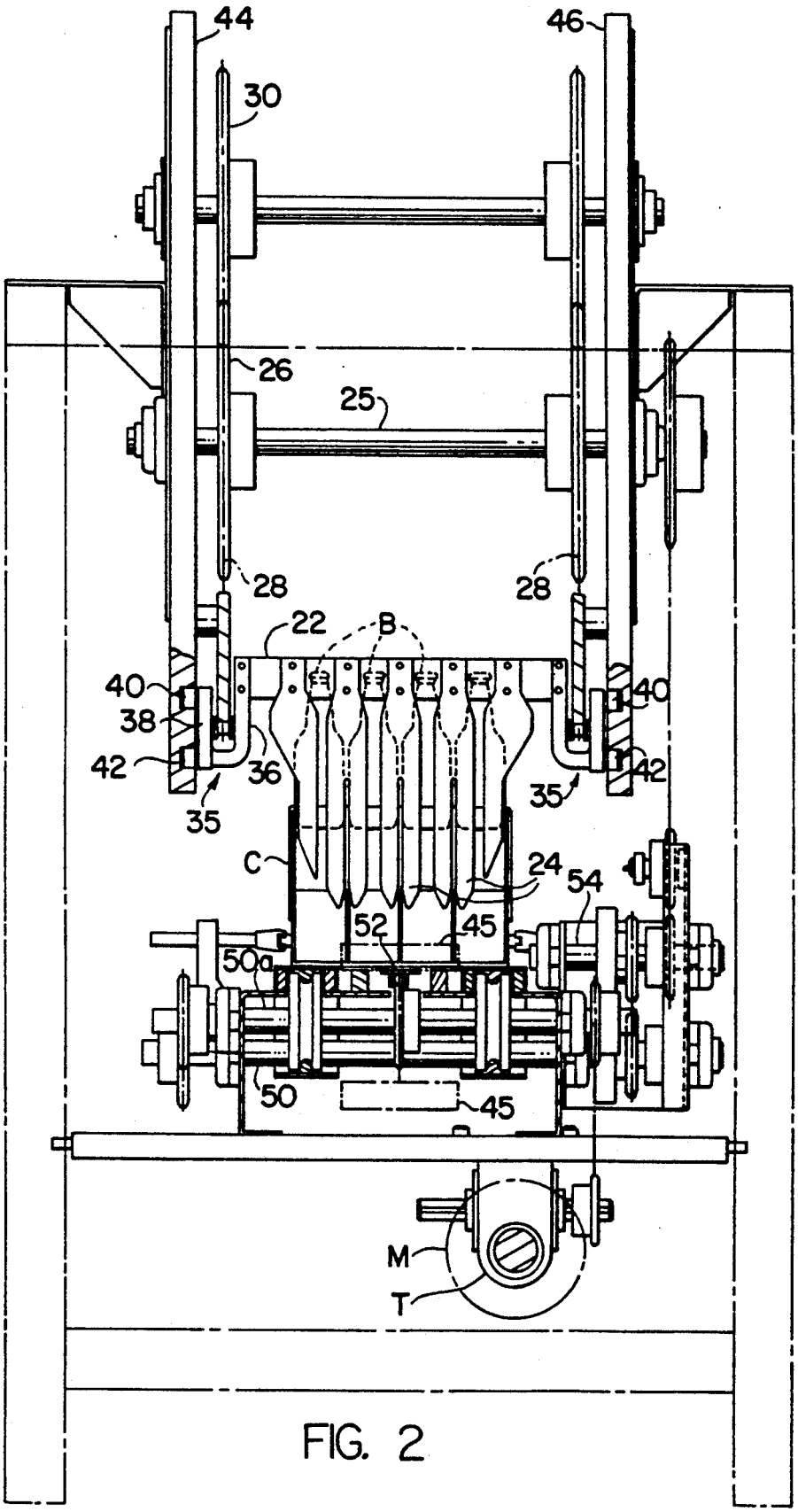
FIG. 2 is a vertical section taken generally on the line 2—2 of FIG. 1 and illustrates the row of containers being deposited into the packing case at the load station.

Still with reference to the overhead flight bar conveyor system 20, means is provided for driving the head shaft and sprocket, 25 and 26 respectively, so as to move the parallel chains 28, 28. These chains 28, 28 are entrained around three sets of sprockets as best shown in FIG. 2 including the head sprocket 26, the tail sprocket 30 and a smaller diameter sprocket 32 located just above the load station.

Figure 5:
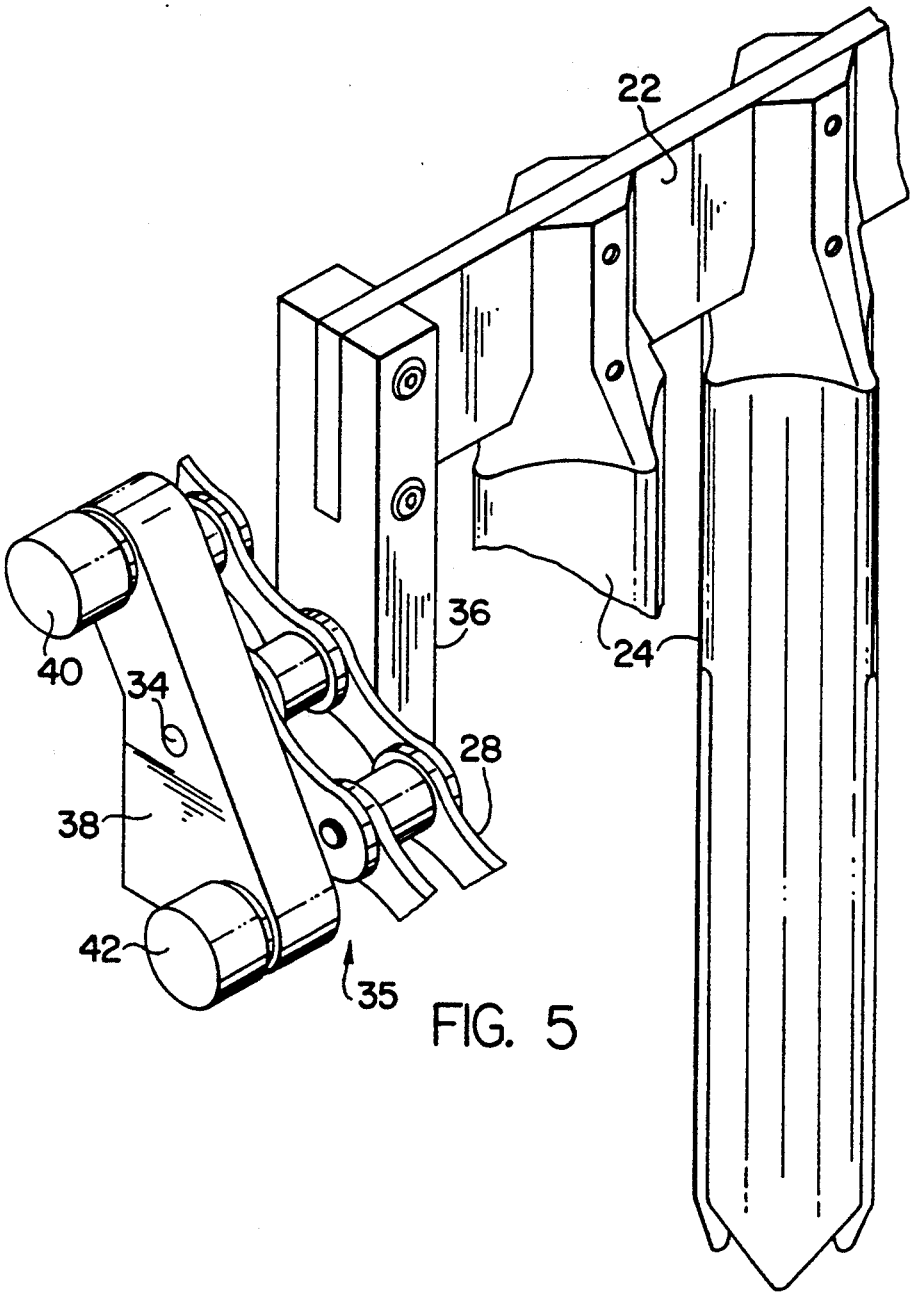
FIG. 5 is a perspective view of one cam follower provided at one end of one flight bar in the overhead flight conveyor system depicted in the drawings.

Each flight bar 22 includes end fittings one of which 35 is illustrated in perspective in FIG. 5, that connect these flight bars to the chains 28, 28. The chain 28 is pinned to the generally U-shaped end fitting of FIG. 6 as suggested at 34. The end fitting includes an inner arm 36 which is secured to the end of the flight bar 22. The end fitting is o generally U-shaped configuration and includes an outer arm 38 which supports a pair of cam follower rollers 40 and 42. These cam follower rollers are provided in slots defined by a fixed cam 46 that is mounted alongside the chain as shown in FIG. 2. Each flight bar 22 has an oppositely configured flight bar fitting 35 provided at the opposite end of the flight bar 22 and such fitting 35 also include cam follower rollers 40 and 42 which are entrained in grooves provided for this purpose in the fixed cam 44. These cam plates 44 and 46 also serve as the fixed support for the above mentioned sprockets which define the paths of movement for the chains 28, 28. The cam slots provided in the fixed cam plates 44 and 46 are so configured as to achieve the path of movement for the fingers that is depicted in FIG. 1. As mentioned earlier the important feature of the present invention is to provide the pegs in a vertical orientation and maintain the upright position of the containers as the containers approach the load station and as the containers are dropped row by row at the load station.

Another important feature of the present invention can be attributed to the fact that the containers B, B are dropped through a height which is only slightly greater than the height H of the packing cases into which the containers are loaded. Referring particularly to FIG. 3 for example, the height H of the packing case C is only slightly greater than the height of the containers being loaded, and the container row being dropped only falls through a distance slightly greater than the packing case height H as the upright container moves off the downstream end of the fingers 16 and is guided by the depending pegs into a pocket defined by the partitions of the packing case itself. With particular reference to FIG. 3, the downwardly moving container provided between the pegs 23 and 24 is guided into the intended pocket within the case by these pegs. As mentioned previously the case pegs 23, 23 have lower ends that are slotted to receive the abutting rear and front end panels of the adjacent packing cases. The longer and smaller diameter container pegs 24 also have lower end portions that are bifurcated to engage the upper marginal edge portions of the partitions provided within the packing case and that serve to define the various pockets for the containers.

The downwardly inclined path of the chain 28 which carries the pegs downstream toward the load station preferably forms an angle $\alpha$ with the path of movement for the containers so as to cause merging of the pegs with the containers and to achieve continued downward movement of the pegs relative to the path of the containers so that the pegs pass through the gaps or spaces provided between the fingers 16, 16 and ultimately enter the packing cases to engage the partitions and packing case front and end wall as described above.

In summary and in accordance with the method or manner of operation of the above described apparatus the packing cases move continuously in a downstream direction end-to-end such that the rear panel of each case abuts the front panel of the next case in line. The cases move continuously through a load station as so oriented. Upright containers are provided in parallel columns, and in laterally aligned rows above the cases and move in the same general downstream direction in a continuous fashion, the containers abut one another as they approach the load station and although separated laterally by lane guides upstream of the load station are also located in close proximity to one another laterally as well. The overhead flight bar conveyor provides a plurality of depending pegs in a grid-like pattern of parallel lateral and longitudinal lines, and defines a downwardly inclined path for the pegs so that the pegs are merged with the containers and move into the spaces defined between the cylindrically shaped containers. The pegs are maintained in a vertical orientation to match the vertical orientation of the containers themselves. The pegs move further downwardly along this incline or along a path inclined with respect to the path of the containers so that the bifurcated lower end portions of the pegs provide slots so that these pegs move into the cases approaching the load station to engage the partitions defining the pockets for the containers. The X-shaped slots in the pegs also engage the abutting front and rear end walls of the case so as to assure that the containers are timed or indexed as they drop row on row into the packing case at the load station. Downstream of the load station the pegs move upwardly in accelerated fashion to permit the loaded cases to be off-loaded. A take away conveyor may be provided to accelerate each loaded case away from the load station once the pegs have moved upwardly away from the last loaded case.

The path for the conveyor chains between the lower sprockets 32, 32 and the head shaft sprockets 26, 26 causes the pegs to exit rapidly from the loaded case, allowing the loaded case to be accelerated away from the packer by suitable means such as by lifting each case in turn by an underlying flight bar take away conveyor system. The take away conveyor system includes a head shaft 50*a* driven through a gear reduction unit T by motor M so as to provide packing case lifting bars 45 on conveyor 52, which bars serve to control the speed of movement of the case exiting the load station. The take away conveyor 52 also drives a cross shaft 50 which is in turn drivingly connected to an oppositely rotating shaft 54 that in turn drives the head shaft 25 of the overhead flight bar conveyor system 20 described previously. Thus, both the overhead flight bar conveyor system 20 and the take away conveyor system are operated in synchronism with one another.

It will be apparent that the above described machine permits loading two or more parallel columns of containers into continuously moving packing cases, and that as so designed represents a substantial improvement over prior art continuous motion packing machines. Although not in the prior art my U.S. Pat. No. 5,020,306 does show a machine for packing two columns of containers in continuously moving end-to-end packing cases. However, this U.S. Pat. No. '306 does not show a machine having the capability of loading more than two columns of upright containers into partitioned packing cases.

The apparatus of the present invention can be conveniently reconfigured to handle containers of different size, whether of different height or of different girth dimension, the vertical height provided between the case conveyor 12 and the container conveyor 10 being adjustable by conventional means. The overhead flight bar conveyor 20 is also adjustable vertically in the frame of the machine, and in order to accommodate variations in the diameter of the containers the overhead flight bar conveyor might be removed and replaced with a flight bar conveyor system wherein the pitch distance of the flights bears an appropriate relationship to the diameter of the containers similar to that described herein. That is, this pitch distance is preferably slightly greater than the girth dimension or diameter D of the containers and is related to the angular inclination of the active path for the pegs as they move downwardly so as to merge with the containers. It will be apparent that in order to handle containers of different heights but of the same girth or diameter one might merely provide for vertical adjustment of the flight bar conveyor system 20 in the machine frame.

For purposes of defining the term "girth" as used in this disclosure and claims said term means the width of the container in the downstream direction. If oval shaped containers are being packed this dimension would depend on the orientation of the containers.

I claim:

1. Apparatus for loading upright containers of girth (D) and height (H) into packing cases having front and rear portions and comprising:

container infeed conveyor means for advancing the containers in parallel in-line columns and in laterally aligned rows, individual container supporting fingers downstream of said infeed conveyor means and gaps between said fingers, said fingers defining parallel paths for the columns of in-line containers, said fingers having downstream ends at a load station, case conveyor means for moving cases end-to-end along a path below the paths of the containers and through said load station, flight bar conveyor means with flights provided at a pitch distance (P) which is slightly greater than the girth (D) of the in-line containers in said columns, said flight bar conveyor means providing an angled path for said flights that is inclined toward the parallel paths of said containers, camming means alongside said inclined path for said flights, and cam followers on said flights to maintain said flights in a particular orientation relative to the containers being moved downstream by said infeed conveyor means, each of said flights having depending pegs provided thereon, said pegs being spaced apart laterally by at least the girth (D) of said containers, said pegs provided in a grid-like pattern and adapted to move between adjacent upright containers and to pass downwardly though said gaps provided between said fingers, at least some of said pegs moving further downwardly into the case as said case approaches said load station whereby the individual containers are guided by said pegs as the containers drop off the downstream end of the fingers into the case at said load station.

2. The apparatus according to claim 1 wherein said fingers define a downwardly inclined ramp for the containers, said ramp forming an acute angle ($\alpha$) with respect to said downwardly moving pegs.

3. The apparatus according to claim 1 wherein said downstream ends of said fingers are spaced above the path of the cases at a height corresponding approximately to the height (H) of the containers.

4. The apparatus according to claim 1 wherein certain of said pegs comprise container pegs configured to enter between adjacent containers that are approximately tangent to one another, and other of said pegs comprise case pegs configured to enter between adjacent containers and to hold back an upstream container row in order to provide a gap in the direction of container movement, said gap corresponding in dimension to the combined thickness of the abutting front and rear portions of the end-to-end cases traversing said load station.

5. The apparatus according to claim 4 wherein said case pegs have downwardly open slots that are laterally aligned with one another, said slots in said case pegs being of substantially the same dimension in the downstream direction as said gap created for said abutting front and rear portions of the end-to-end cases traversing said load station.

6. The apparatus according to claim 5 wherein said cases have partitions, and wherein said container pegs have downwardly open slots of substantially the same dimension as the thickness of said partitions.

7. The apparatus according to claim 6 wherein said container pegs each have X-shape slots to receive partitions running both laterally across said case and partitions running in the direction of case movement.

8. The apparatus according to claim 3 wherein said case conveyor means comprises a horizontally extending continuously moving upper run for frictionally engaging the bottom of the end-to-end cases, said cases having a height dimension approximately the same as the height (H) of said containers.

* * * * *